US005819322A

United States Patent [19]

Dicker et al.

[11] Patent Number: 5,819,322

[45] Date of Patent: Oct. 13, 1998

[54] ENERGY CONSERVATIVE/EXPENDITURE GARMENT

[76] Inventors: Timothy P. Dicker, 6906 Foothill Blvd., Tujunga, Calif. 91042-2780; William T. Wilkinson, P.O. Box 73, Salem, N.J. 08079

[21] Appl. No.: 880,775

[22] Filed: Jun. 23, 1997

[51] Int. Cl.[6] ..... A42B 3/00

[52] U.S. Cl. ..... 2/456; 2/425; 2/171.3; 2/69

[58] Field of Search ..... 2/410, 411, 422, 2/425, 456, 69, 255, 171.3, 184.5, 205, 209.13, 455; 482/57, 58, 105, 111, 121, 124

[56] References Cited

U.S. PATENT DOCUMENTS

| | | | |
|---|---|---|---|
| 1,178,165 | 8/1916 | Lupton . | |
| 2,097,376 | 10/1937 | Marshman . | |
| 2,613,932 | 10/1952 | Manners . | |
| 3,411,500 | 11/1968 | Gatts . | |
| 3,559,654 | 2/1971 | Pope . | |
| 3,566,409 | 3/1971 | Hopper | 2/171.3 |
| 3,759,510 | 9/1973 | Jackson . | |
| 4,065,814 | 1/1978 | Fox . | |
| 4,220,299 | 9/1980 | Motter . | |
| 4,325,379 | 4/1982 | Ozbey . | |
| 4,384,369 | 5/1983 | Prince . | |
| 4,670,913 | 6/1987 | Morell . | |
| 4,698,847 | 10/1987 | Yoshihara . | |
| 4,910,802 | 3/1990 | Malloy . | |
| 4,953,856 | 9/1990 | Fox . | |
| 4,961,573 | 10/1990 | Wehrell . | |
| 4,968,028 | 11/1990 | Wehrell . | |
| 4,993,705 | 2/1991 | Tolle . | |
| 5,033,123 | 7/1991 | Audet . | |
| 5,046,194 | 9/1991 | Alaniz . | |
| 5,060,315 | 10/1991 | Ewing . | |
| 5,062,642 | 11/1991 | Berry . | |
| 5,109,546 | 5/1992 | Dicker . | |
| 5,141,223 | 8/1992 | Block . | |
| 5,176,600 | 1/1993 | Wilkinson . | |
| 5,186,701 | 2/1993 | Wilkinson . | |
| 5,201,074 | 4/1993 | Dicker . | |
| 5,203,754 | 4/1993 | Maclean . | |
| 5,256,119 | 10/1993 | Tudor . | |
| 5,263,916 | 11/1993 | Bobich . | |
| 5,267,928 | 12/1993 | Barile . | |
| 5,282,277 | 2/1994 | Onozawa . | |
| 5,306,222 | 4/1994 | Wilkinson . | |
| 5,308,305 | 5/1994 | Romney . | |
| 5,336,139 | 8/1994 | Miller . | |
| 5,337,421 | 8/1994 | Jeng | 2/425 |
| 5,357,637 | 10/1994 | Moore . | |
| 5,367,708 | 11/1994 | Fujimoto . | |
| 5,372,565 | 12/1994 | Burdenko . | |
| 5,375,610 | 12/1994 | LaCourse . | |
| 5,383,235 | 1/1995 | Peters . | |
| 5,465,428 | 11/1995 | Earl . | |
| 5,518,480 | 5/1996 | Frappier . | |
| 5,518,481 | 5/1996 | Darkwah . | |
| 5,570,472 | 11/1996 | Dicker . | |
| 5,734,990 | 4/1998 | Waring | 2/69 |

*Primary Examiner*—Michael A. Neas
*Attorney, Agent, or Firm*—Connolly & Hutz

[57] ABSTRACT

Energy conservation or expenditure garments are designed for use by cyclists. The garment includes in one embodiment an air cooling system through use of various air passageways in the energy conservation garment. In another embodiment the energy expenditure garment includes pockets to offer drag or resistance to the user. An indicator may be provided at the back of the hand portion of the garment to indicate some parameter of exercise.

8 Claims, 4 Drawing Sheets

10
64
66
18
58
74
68
72
70
56

ENERGY CONSERVATIVE/EXPENDITURE GARMENT

BACKGROUND OF THE INVENTION

The present invention relates to garments which either conserve energy or cause energy expenditure. Garments for expending energy have been known which incorporate elongated elastic resistance elements as separate cords or bands or as panels of the garments. In use of the garments when the user performs certain activities, such as bending motions of the hands, legs or body, energy is expended in stretching the resistance material and then in resisting the material to returning to its original condition. It would be desirable to make use of such concepts where the activity being performed is, for example, the riding of a bicycle or stationary cycle which would involve the user assuming a bent position on the cycle while pedaling. It would also be desirable if such a garment could be provided with some form of indicator so that the user would readily be informed of some condition of the exercise, such as body temperature, pulse rate or calories burned. It would further be desirable if a garment could conserve energy.

SUMMARY OF THE INVENTION

An object of this invention is to provide a garment particularly designed for use by cyclists.

Another object of this invention is to provide such a garment which is intended to conserve energy.

An alternative object of this invention is to provide a garment to be worn by cyclists which would cause expenditure of energy.

A further object of this invention is to provide an accessory for a garment which would give some indication to the user indicative of parameters reflecting the energy expended.

In accordance with one embodiment of this invention, the garment is an energy conservation garment designed to be worn by a cyclist. The garment would include a body suit covering the user's body and limbs. In addition, a helmet would be provided connected to the body suit by a nape piece at the back of the helmet. The garment has an air cooling system including air channels extending down the back of the helmet through the nape piece into a pouch or pocket in the back of the body suit. The pocket has an open distal end to permit air circulation. The body suit would be provided with exhaust openings communicating with the air channels. When the user is in the bent cycling position, the channel inlets at the top of the helmet are disposed forwardly for the ready entry of air. The garment could include various support bands and compression rings so as to relieve postural tension as well as pooling the blood in the extremities.

In a further embodiment of this invention an energy expenditure garment could include air drag structure such as pockets at the sides of the garment such as in the area of the ribs to require a greater expenditure of energy in performing the cycling.

In a still further embodiment of this invention an energy expenditure garment having a body portion and arms would include an indicator attached to the garment preferably in the general area of the back of the wrist for ready visibility by the user to indicate at least one parameter indicative of exercise expenditure.

DETAILED DESCRIPTION

The present invention is directed to providing either an energy conservation garment or an exercise expenditure garment which would be used by cyclists, such as bicycles where the user is in a forwardly bent position. The invention may be practiced with other forms of cycles, such as stationary exercise cycles, unicycles, tricycles, etc. The basic garment, particularly when used for expending energy, could include resistance elements along the principles of our various patents and applications with modifications intended to make the garment particularly useful for cyclists. Such resistance elements could be panels integral with the garment or separate bands or cords. Reference is made to our U.S. Pat. Nos. 5,109,546; 5,176,600; 5,186,701; 5,201,074; 5,306,222 and 5,570,472, as well as pending applications Ser. No. 627,426 filed Apr. 4, 1996, Ser. No. 761,290 filed Dec. 6, 1996 and Ser. No. 802,973 filed Feb. 20, 1997. All of the details of the aforenoted patents and applications are incorporated herein by reference thereto.

Figure 1:
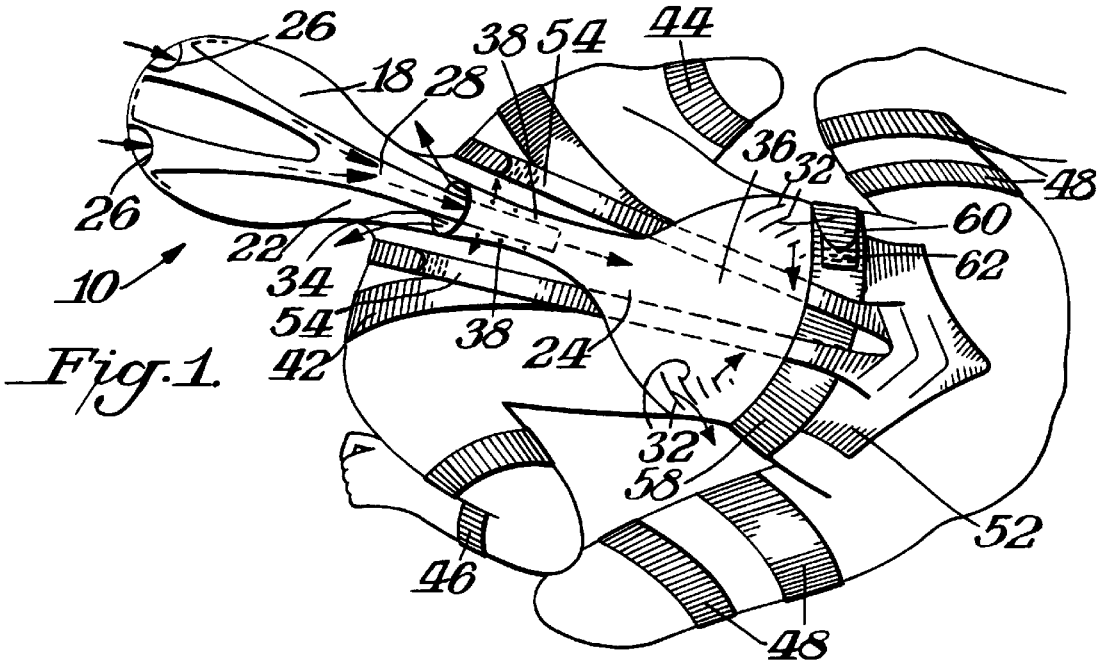
FIG. 1 is a rear or anterior elevational view of an exercise conservation garment designed for cyclists in accordance with this invention.
Figure 2:
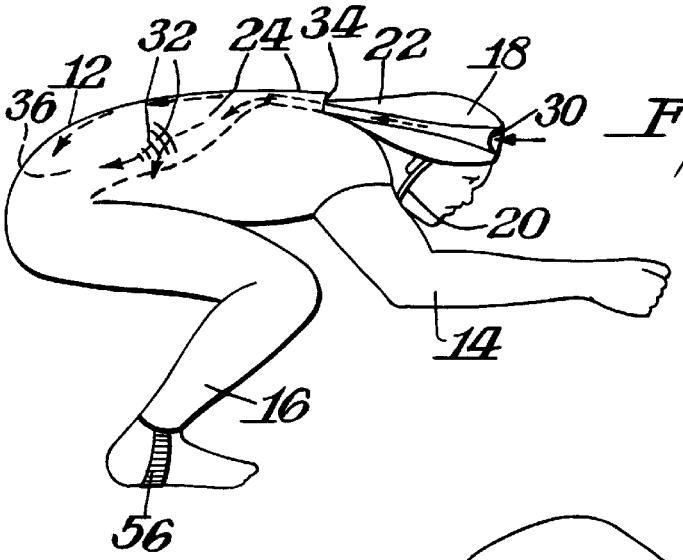
FIG. 2 is a side elevational view of the air cooling system in the garment shown in FIG. 1.
Figure 3:
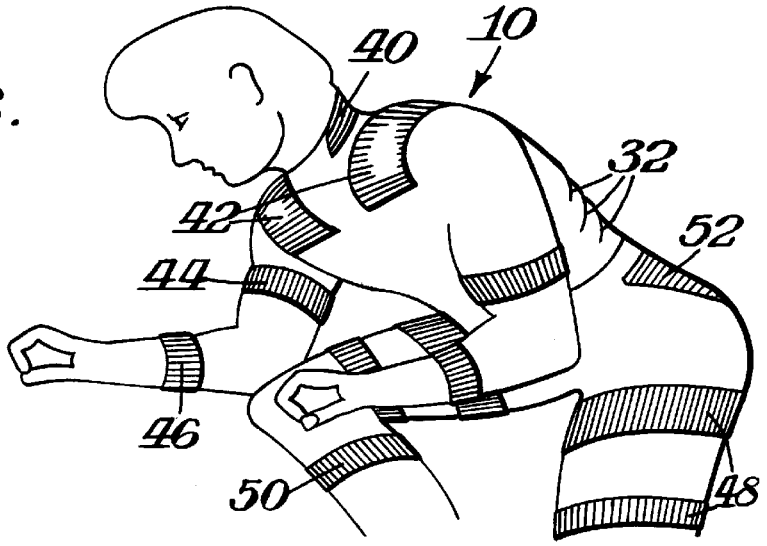
FIG. 3 is an anterior or front elevational view showing the resistance elements in the garment shown in FIG. 1.

FIGS. 1–3 illustrate an energy conservation garment 10 in accordance with this invention particularly designed to be worn by a cyclist. In general, garment 10 includes an air cooling system for the cyclist which is shown in FIG. 2 and support elements which are shown in FIG. 3. FIG. 1 shows the air cooling system and support elements combined into a single garment.

As shown in FIGS. 1–3 the garment 10 would include a body suit 12 which could be generally of the various forms with one piece or two piece construction as in our above noted patents and applications. The body suit 12 includes arms 14 and legs 16. In accordance with this invention a helmet 18 is also provided. Helmet 18 is of flexible or rigid form to closely fit on the user. FIG. 2 shows a strap 20 extending from the helmet 18 under the chin to hold the helmet in place. Helmet 18 includes a nape piece or extension 22 which slides into a pocket 24 secured to the inner surface of body portion 12.

As best shown in FIGS. 1–2 air channels 26,26 are provided on opposite portions in the back of helmet 18 and join each other to form a common channel or passageway 28 at the nape piece 22. Each channel 26 has an inlet or open end 30. When the cyclist is in the bent forward position normally assumed on a bicycle or other similar cycle, the inlets 30 are disposed directly in front of the user so that during the cycling air passes into the inlets 30 and through the air channels 26,28 for passage into the pockets 24. The air then flows through body 12 in the manner illustrated in FIGS. 1–2 and exits through various air exhaust vents, such as vents 32 at the sides of the body portion 12.

Because the mouth 34 of pouch type air channel 24 is larger than the nape piece 22 there is clearance around the nape piece which permits air to also be exhausted through the open mouth 34 of pouch 24. As illustrated in FIGS. 1–2, pouch 24 is secured to the inside surface of body portion 12 of garment 10. The pouch 24 has an open end generally indicated by the reference numeral 36 which thus permits the air flow to spread throughout the inner surface of the garment 10 and to permit air to be exhausted through the side vents 32 and mouth 34. Scapular hole outlets 38 are also provided in pouch 24 just downstream from open mouth 34 to permit air flow in the constricted portion of pouch 24. The open end 36 of pouch 24 is generally located at the lower back portion of the user. The air circulation created by the arrangement shown in FIGS. 1–2, thus provide an effective cooling system for the cyclist from the neck down to the lower back.

It is intended to provide garment 10 with support elements in addition to the cooling system. Such support elements could be reinforcements or stiffened portion of the garment. FIG. 3 illustrates one manner of incorporating such support elements. As shown therein an anterior neck support band 40 is incorporated at the upper portion of garment 10. The nape piece 22 would extend over band 40. FIG. 3 also illustrates anterior scapular support bands 42. In addition, as shown in FIG. 3, arm support bands 44, forearm support bands 46, leg support bands 48, calf support bands 50 and lumbar spinal support band 52 are provided on garment 10. These various support bands may be endless bands of a compressive nature as described in co-pending application Ser. No. 761,290 filed Dec. 6, 1996.

Various other support elements are shown in FIG. 1. These include paraspinal support bands 54 and lumbar spinal support band 52. If desired, an adjustable compressive waistband 58 may be provided having its free ends 60 adjustably connected by in any suitable manner such as VELCRO® (hook and loop fastener) structure 62. Waistband 60 would be particularly preferred where garment 10 is of two piece construction.

The garment of FIGS. 1–3 is distinctly different from energy expenditure garments in that it is actually an energy conservation garment. The garment functions to relieve postural tension and pulls the blood in the extremities by way of the compression rings thereby increasing energy. With the garment of FIGS. 1–3 it is not necessary to have anchor points as for resistance elements in energy expenditure garments. Accordingly, the concept involved in the garment of FIGS. 1–3 is opposite to the approaches used for energy expenditure garments.

As noted, the garment of FIGS. 1–3 includes various appropriately located supports. The result is to support biking posture and promote stamina and muscle energy conservation. The compression rings, such as rings 44, 46, 48 and 50 on the arms and legs promote increased heat, decreased muscle wobble, increased blood pooling, increased ATP production, increased stability and decreased fatigue.

The utilization of the air cooling system in the garment of FIGS. 1–3 is particularly advantageous in providing cooling over the body area such as at the location of the kidneys. By having the vents 32 directed in opposite directions there is an effective circulation of the cooling air through the garment.

In accordance with another aspect of this invention an energy expenditure garment is provided which is particularly designed to be used for increasing energy expenditure during biking or cycling. The garment is preferably made in one or two pieces and is intended to help the user get more exercise while cycling indoors or outdoors, but preferably outdoors. The garment can include one or more of the following features, 1) resistance bands, preferably with adjustable tension for the upper body (arms) and lower body (legs), 2) a resistance band, preferably with adjustable tension that runs from the shoulders down the back to the lower back that allows for torso exercise and low back support, 3) a compression band or belt about the waist, preferably adjustable that is incorporated into the clothing and provides one or more of the functions of mid-section support (low back and abdomen), and weight loss (sweat or heat generation about the stomach/mid-section).

Having resistance bands of the upper and lower body helps the cyclist get more exercise particularly over flat terrain. When going uphill the resistance can be increased by adjusting/relaxing/decreasing the tension.

By having a resistance band that runs from the shoulders down the back to the lower back the garment helps reduce pressure on the wrists and arms and hands and also supports the back and low back. The bands exert a backward pull on the upper back and shoulders during the cycling.

The compression band enhances weight/water loss during a workout.

Figure 4:
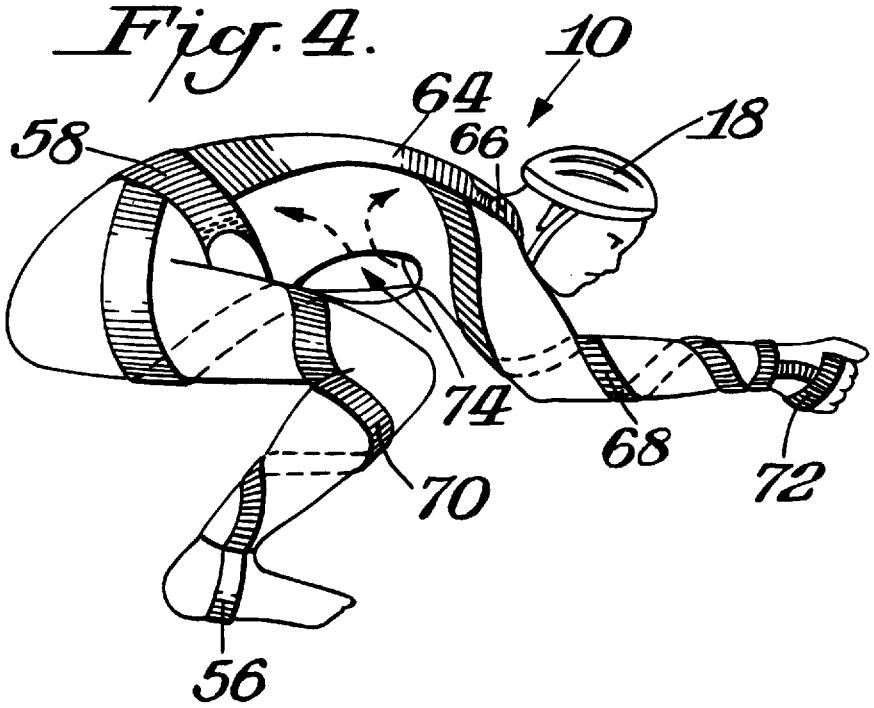
FIG. 4 is a side elevational view of an energy expenditure garment in accordance with this invention.

The invention may be practiced where such resistance/compression bands are incorporated in a garment such as illustrated in FIG. 4 which includes upper body panels or pockets to catch air/wind for causing or creating a drag or resistance during the cycling. Preferably the pockets have an open inlet end and are otherwise closed. In this manner there is an increase in the exercise at greater speeds. Alternatively, these benefits could be achieved from a hood that catches air/wind. In effect, the pocket or hood functions as a barrier disposed in the path of air flow thus increasing the drag.

As shown in FIG. 4 the garment 10 has resistance bands 64 which are provided with tension adjusting structure such as buckles 66. Resistance bands 64 extend on the body portion of the suit for providing resistance to the upper and lower portions of the body. FIG. 4 also illustrates a spirally arranged arm resistance band 68 for each arm of the suit and a spirally arranged leg resistance band 70 for each leg. Band 70 could be anchored by foot stirrup 56 and arm band could be anchored by hand loop 72. (FIG. 2 also shows foot stirrup 56). Preferably an adjustable waist band 58 is also provided. The sides of garment 10 include air drag pockets 74 on each side thereof to catch the wind or air and thereby create a drag requiring greater energy expenditure by the cyclist. Instead of, or in addition to, the side pockets 74 a hood could be provided at any suitable location on the garment 10. Garment 10 could include a cooling system with suitably located vents or exhaust holes as described with respect to FIGS. 1–3.

Figure 5:
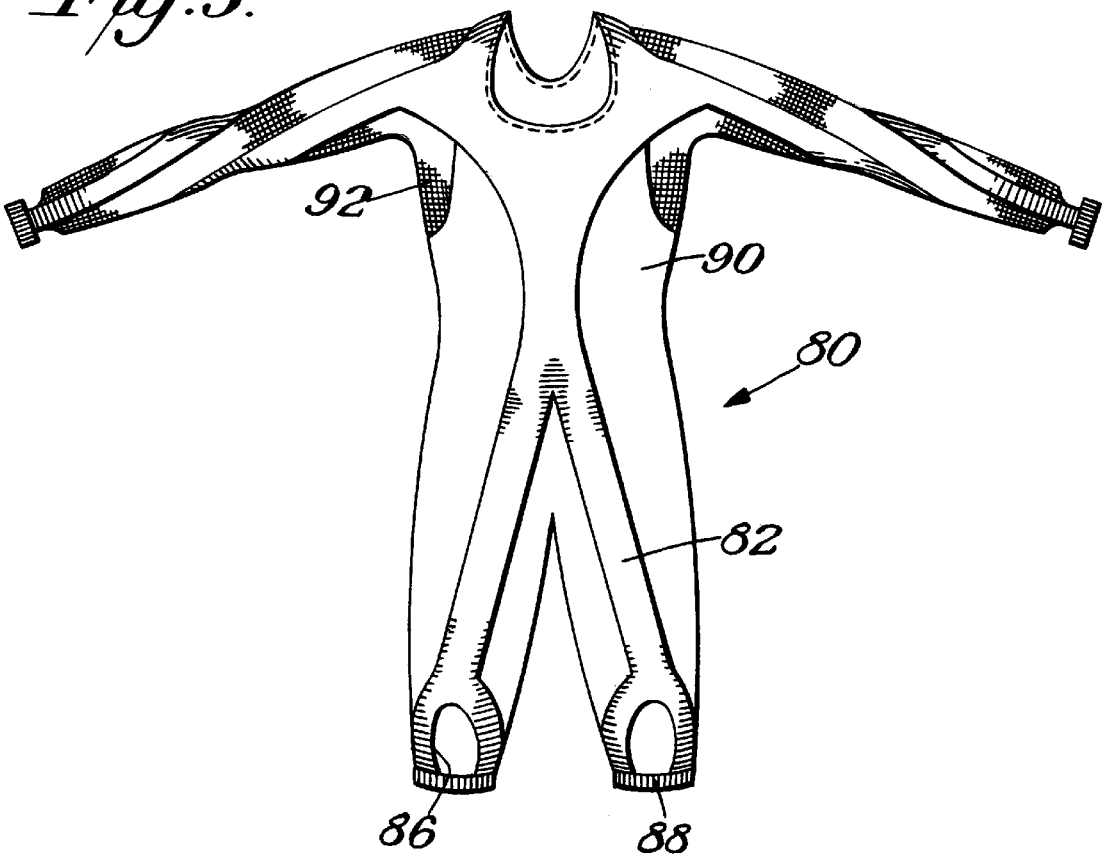
FIG. 5 is a front elevational view of still yet a further exercise expenditure garment in accordance with this invention.
Figure 6:
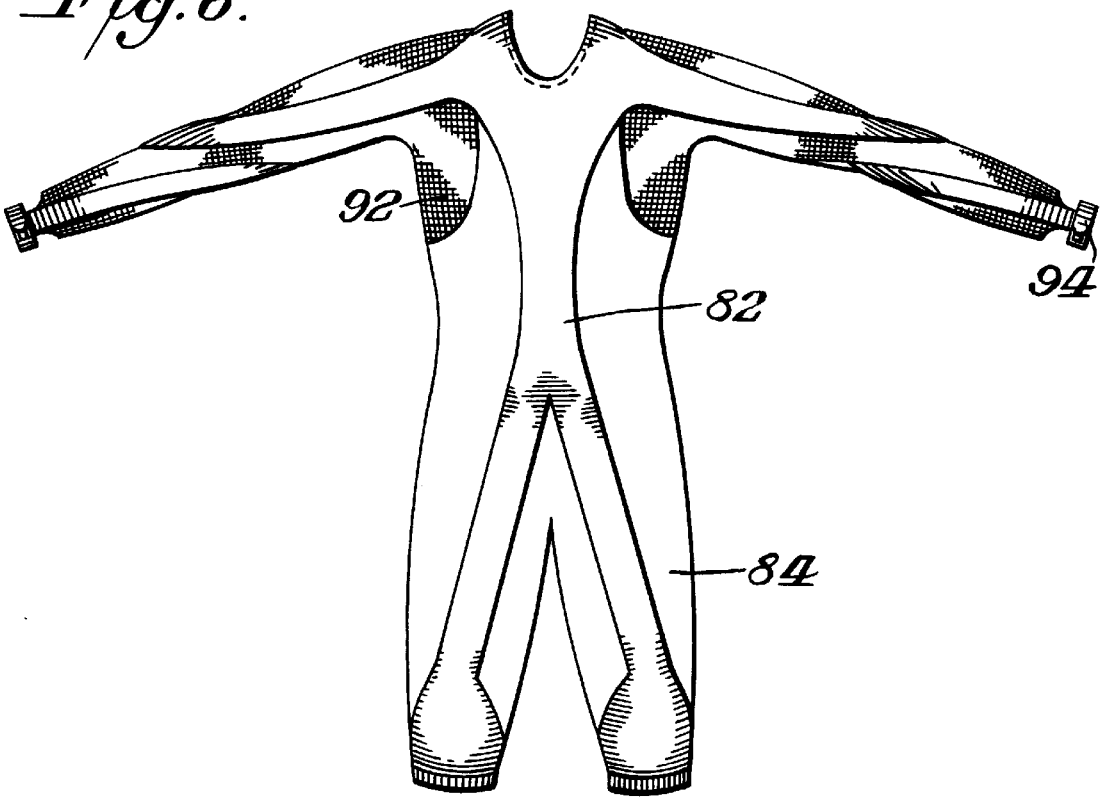
FIG. 6 is a rear elevational view of the garment shown in FIG. 5.

FIGS. 5–6 illustrate an energy expenditure garment 80 which is provided with elastic resistance elements, particularly located on the garment for use by a cyclist. As shown therein elongated resistance elements 82 are provided which extend longitudinally down the front of the garment and separate into leg bands and arm bands with similar bands 82 provided on the rear of the garment. Garment 80 is particularly intended for summer or indoor use and thus the legs 84 terminate at about the knee with an opening 86 being provided in band 82 at the front of the garment. The band 82 terminates in a compressive anchoring cuff 88 below the knee. As illustrated the arm bands are anchored by adjustable hand loops or wrist cuffs 94. Other portions of the garment are made of different elastic characteristics than the elastic band 82. These other portions include portions 90 which extend over most of the body portion of the garment and portions 92 which extend primarily on the arms of the garment. If desired, greater resistance force is imparted by portions 90 than portions 92 with the resistance bands 82 providing the most resistance force.

FIGS. 7–10 illustrate variations in a further aspect of the invention which relates to providing an exercise garment (i.e. an energy conservation or energy expenditure garment) with an exercise indicator to readily make apparent to the user some parameter indicative of the degree of exercise. Such indicator could be a permanent but is preferably a detachable device worn with the garment during exercise or physical activity. The indicators shown in FIGS. 7–10 are located so as to be readily visible by a cyclist. Thus, the indicators would be readily adaptable to the types of garments previously described in FIGS. 1–6 intended for use by a cyclist. It is to be understood, however, that the aspect of the invention as regards the indicator is not intended to be limited to a cycling garment, but could be used with any type of energy expenditure garment such as described in the noted patents and applications or with an energy conservation garment. The specific details of the indicator are not critical and any known indicators can be used. What the invention is based on is the recognition and adaptability that the indicators are incorporated in an exercise garment, particularly at locations so as to be readily visible to the user.

The indicator would register various information on the state of the user's physical condition, such as body temperature, pulse rate and/or calories burned. In addition, the device could record elapsed time, distance covered, or direction (compass feature) Such features have been known with runner's watches.

The indicator could be worn anywhere on the clothing, but preferably is worn on the back of a glove or the back of a wrist or forearm where it is thereby easily visible and easily manipulated for resetting purposes. The various data could be registered and made known to the user in any suitable manner such as by lights (LED), some mechanical indication such as numbers or arrows, some audio indication such as buzzers, beepers or other alarms, or by colors. Thus, for example, when a certain threshold of danger is reached an alarm might sound or the colors might progressively change from green to yellow to red or a light might be turned on or flash, or some actual numerical parameter indicative of the condition could be displayed.

In a preferred form of the invention the indicator is a heat sensitive disc that can be snapped into the back of a glove, or onto the back of a glove or underneath the back of a glove. The indicator can, but does not have to come into direct contact with the skin. In the preferred practice, there is, however, direct contact. The indicator preferably is capable of having an input of data such as the user's body weight to assist in certain calculations.

Figure 7:
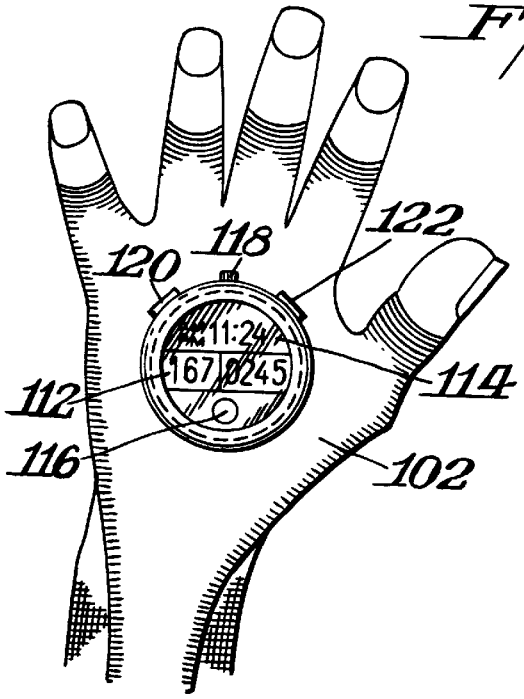
FIG. 7 is a front elevational view of a garment incorporating an exercise expenditure indicator in accordance with this invention.
Figure 8:
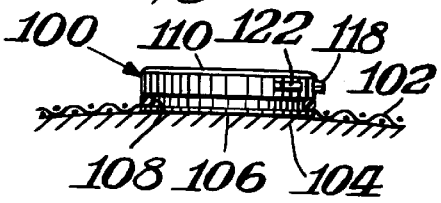
FIG. 8 is a side elevational view of the indicator and garment shown in FIG. 7.

FIGS. 7–8 illustrate one form of indicator 100. As shown therein indicator 100 is associated with a glove 102 which is part of an exercise garment such as an energy conservation garment or an energy expenditure garment such as one of the garments previously described or could be one of the garments described in the aforenoted patents and applications. The illustrated glove 102 is a glove shown as a cycling glove having the outer digits of the fingers exposed. Indicator 100 in the version shown in FIG. 8 comes in direct contact with the skin 104 of the user by having an annular opening in the glove 102. Specifically, a lower circular heat sensitive disc 106 serves as the base of indicator 100. Base 106 has an annular groove for receiving an O-ring 108 permanently secured to glove 102. The remainder of indicator 100 is the outer housing portion 110 that is permanently connected to disc 106.

Various exercise indicating parameters and other information could be displayed on indicator 100. For example, as shown in FIG. 7 a panel 112 indicates the amount of calories burned. Another panel 114 indicates the time. An LED light 116 would be activated when some predetermined condition is met, such as pulse rate, temperature, etc. As shown the indicator 100 is mounted on the back of the glove 102 opposite the palm so that when the user's hand is in front of the user around the handlebars of a cycle, the back of the glove would be the portion of the glove readily seemed.

If desired, indicator 100 could be provided with various structure for resetting different parameters, such as a stop timer button 118, a time reset button 120 and a parameter reset button 122 for the parameter displayed on panel 112.

Figure 9:
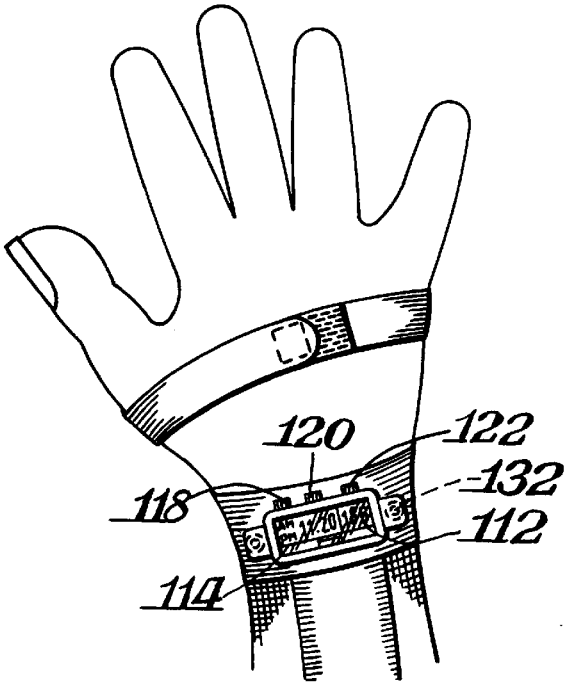
FIG. 9 is a front elevational view of a modified form of indicator and garment in accordance with this invention.
Figure 10:
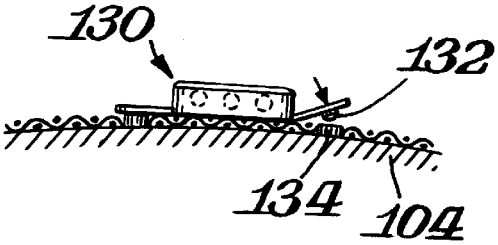
FIG. 10 is a side elevational view of the indicator and garment shown in FIG. 9.

FIGS. 9–10 illustrate a variation of the invention wherein an indicator 130 is provided on a wrist band or loop which is part of an exercise garment. Indicator 130 could be mounted in direct contact with the skin in the same manner as indicator 100. FIG. 10, however, illustrates the variation where the indicator 130 is mounted with the wrist band material interposed between the indicator and the skin 104. FIG. 10 also illustrates an alternative manner of detachable mounting for indicator 130 which includes snap lugs 132 mounted into snap receptacles 134. Indicator 130 could have the same functions and displays as indicator 110. FIG. 9 illustrates a display panel 112 for an exercise parameter and a clock panel 114 as well as reset buttons 118, 120, 122 which function as in the same manner as indicator 100.

As with indicator 100 indicator 130 would also be worn on the back of the hand for ready viewing by the user.

Although the indicator is illustrated as being on the back of the wrist area, any other location on the garment could be used. Suitable locations are the arms, legs and torso and even on the head such as a helmet or sweatband. It is not necessary to have the indicator readily visible particularly where the indicator includes an audio signal. Even where the signal is visual, the indicator could be in a location not readily viewable to the user which would simply require some extra effort for the user to see the indicator or have a companion view the indicator.

As noted this embodiment of the invention regarding the indicator does not reside in the indicator structure itself or in the specific exercise parameter being sensed and indicated. Rather, it is the recognition that such indicators could be incorporated in or associated with an exercise garment. As noted, the indicator could be a permanent part of the garment. Preferably, the indicator is detachably secured to the garment so that the same indicator could be used for other garments or so that the indicator could be removed to permit the garment to be cleaned without damaging the indicator.

What is claimed is:

1. An energy conservation garment comprising a body suit to be worn on the body of a user, a helmet to be worn on the head of a user, said helmet having a back and a front, a nape piece connected to said back of said helmet and mounted to said body suit, an air cooling system in said helmet and said body suit, said air cooling system including at least one air channel extending down said back of said helmet and through said nape piece and into said body suit, and exhaust openings in said body suit communicating with said air channel.

2. The garment of claim 1 wherein a pouch is formed on the inner side of said body suit, said pouch having a mouth at one end thereof into which said nape piece extends, and the other end of said pouch being open.

3. The garment of claim 2 wherein said at least one channel comprises a pair of spaced channels extending down said back of said helmet and merging into a single passageway at said nape piece.

4. The garment of claim 3 wherein said suit includes exhaust vents for exhausting air flowing through said passageway and into said pouch, and said mouth of said pouch comprises a further exhaust for the air.

5. The garment of claim 4 wherein each of said channels has an inlet at the top of said helmet for facing forward when the user is in a cycling position.

6. The garment of claim 5 including endless compression bands on the arms and legs of said garment.

7. The garment of claim 6 including support members on the back of said garment.

8. The garment of claim 1 wherein said body suit includes a wrist portion with a front side and a back side, and an exercise parameter indicator mounted on said back side of said wrist portion.

* * * * *